United States Patent [19]

Munn

[11] 4,370,874

[45] Feb. 1, 1983

[54] UNIVERSAL LATCH-LOCK ASSEMBLY

[76] Inventor: Fred O. Munn, 4510 Town & Country Dr., Charlotte, N.C. 28211

[21] Appl. No.: 287,160

[22] Filed: Jul. 27, 1981

[51] Int. Cl.[3] ..... E05B 5/02; E05B 13/00; E05B 63/04; E05C 3/04

[52] U.S. Cl. ..... 70/204; 70/81; 70/211; 70/451; 70/462; 292/DIG. 31; 292/DIG. 54; 292/244; 292/241; 292/210; 292/204

[58] Field of Search ..... 70/208, 211, 81, 135, 70/451, 461, 462; 292/DIG. 31, DIG. 54, DIG. 23, 210, 204, 240, 241, 244

[56] References Cited

U.S. PATENT DOCUMENTS

| | | | |
|---|---|---|---|
| 119,673 | 10/1871 | Warner et al. | 292/244 X |
| 159,365 | 2/1875 | Snow | 292/241 |
| 1,995,338 | 3/1935 | Andrews | 70/208 X |
| 2,223,236 | 11/1940 | Barrington et al. | 292/DIG. 31 |
| 2,375,196 | 5/1945 | Cederwall | 70/208 X |
| 2,377,301 | 5/1945 | Rolph | 70/208 |
| 2,763,503 | 9/1956 | Tasch et al. | 292/DIG. 31 |
| 2,772,809 | 12/1956 | Ross | 292/DIG. 31 |
| 2,919,570 | 1/1960 | Crew | 70/211 |
| 4,080,813 | 3/1978 | McKann | 70/461 X |
| 4,231,597 | 11/1980 | Pelcin | 292/DIG. 31 |

FOREIGN PATENT DOCUMENTS

| | | | |
|---|---|---|---|
| 211330 | 6/1909 | Fed. Rep. of Germany | 70/208 |
| 230657 | 2/1911 | Fed. Rep. of Germany | 292/244 |
| 461343 | 6/1928 | Fed. Rep. of Germany | 292/204 |
| 643851 | 4/1937 | Fed. Rep. of Germany | 292/244 |
| 2160563 | 9/1979 | Fed. Rep. of Germany | 70/462 |
| 500340 | 11/1954 | Italy | 292/204 |

*Primary Examiner*—Cornelius J. Husar
*Assistant Examiner*—Carl F. Pietruszka
*Attorney, Agent, or Firm*—Bell, Seltzer, Park & Gibson

[57] ABSTRACT

The latch assembly is provided with a locking collar and a pair of knockouts so that the latch assembly can be easily converted to a latch-lock assembly by simply inserting a cylinder lock in the proper knockout, depending upon whether the assembly is used in a right-hand or left-hand installation. The conversion of the assembly may be made before or after installation of the latch-lock assembly.

5 Claims, 6 Drawing Figures

UNIVERSAL LATCH-LOCK ASSEMBLY

FIELD OF THE INVENTION

This invention relates generally to a latch-lock assembly which is particularly adapted for use on a hinged door or panel of the type usually employed in metal lockers, storage cabinets and the like, and more particularly to a T-handle type latch assembly which is provided with a pair of knockouts and a key-operated locking cylinder may be mounted in either one of the knockouts so that the latch assembly may be quickly and easily converted to a latch-lock assembly for either right-hand or left-hand operation.

BACKGROUND OF THE INVENTION

It is the current practice to manufacture T-handle nonlocking latch assemblies as well as key locking latch assemblies for installation in either right-hand or left-hand hinged doors or panels. It is also necessary for manufacturers of metal cabinets and the like to stock T-handle nonlocking latch assemblies, right-hand key locking latch assemblies, and left-hand key-locking latch assemblies, in order to be able to provide the customer with the desired type of latch on the metal cabinet. In some instances, a cabinet is provided with a nonlocking latch and, after delivery, it is decided that it would be desirable to provide the cabinet with a key-locking latch and the entire latch assembly must then be changed to provide the key-locking feature. The manufacture of these various types of latch assemblies increases the cost of manufacture. Also, it is expensive to maintain an inventory of each different type of latch assembly.

SUMMARY OF THE INVENTION

With the foregoing in mind, it is an object of the present invention to provide a universal type of latch assembly adapted for either right-hand or left-hand installation, which may be used as a nonlocking latch assembly, or may be easily and quickly converted to a key-locking assembly in either a right-hand or left-hand installation. The present latch assembly may be converted to a latch-lock assembly either before or after installation in a metal cabinet or the like.

In accordance with the present invention, the latch housing is provided with a knockout on each side of the operating handle. Either before or after installation of the latch assembly, the assembly may be easily converted to a key-locking assembly by removing one of the knockouts and inserting a key-operated locking cylinder therein. The key-operated locking cylinder cooperates with a locking collar fixed on the operating handle latch-operating stem and the locking collar includes locking notches engageable by the key-locking cylinder for locking the latch assembly.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
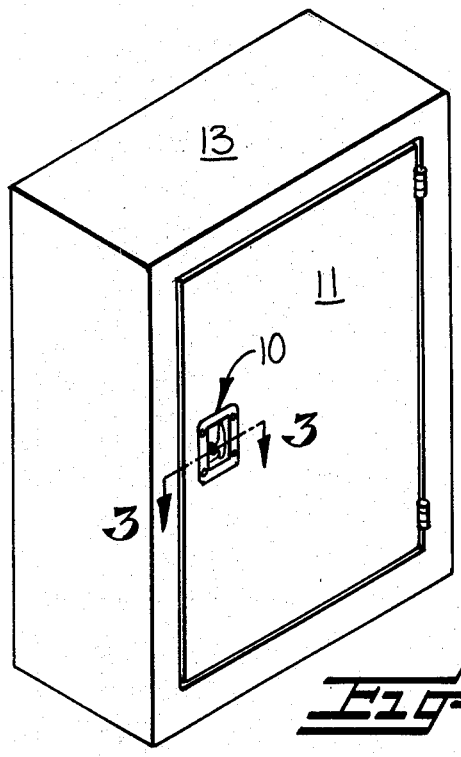
FIG. 1 is an isometric view of a metal storage cabinet with the latch assembly of the present invention installed in a door mounted for left-hand swinging movement.
Figure 3:
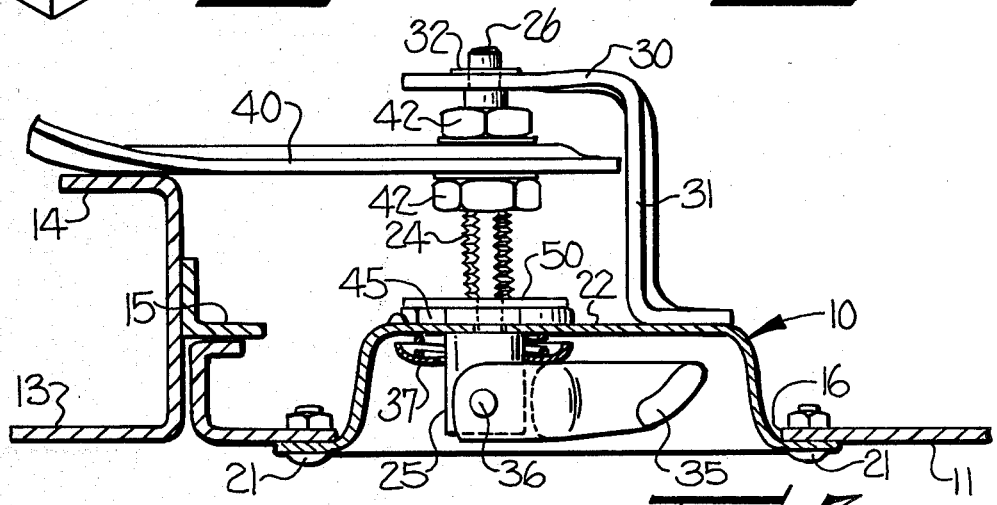
FIG. 3 is an enlarged fragmentary horizontal sectional view taken substantially along the line 3—3 in FIG. 1.

The latch assembly, broadly indicated at 10, is illustrated in FIG. 1 as being mounted in a "flush" condition in a cabinet panel or door 11 which is supported for left-hand swinging movement by hinges 12 in the mating frame of a metal cabinet 13. As illustrated in FIG. 3, the mating frame of the cabinet 13 is bent inwardly and forms a latching rim 14. A door stop 15 is fixed on the frame and the edge of the panel 11 is also bent inwardly and forms a stop which engages the door stop 15 when the door 11 is closed, as illustrated in FIG. 3.

The latch assembly 10 is mounted in a rectangular opening 16 (FIG. 3) in the door 11 and includes a pan-shaped housing with a peripheral rim 20 mounted on the door 11, as by bolts 21, and surrounding the opening 16. A depressed central surface 22 is provided in the pan-shaped housing and extends inwardly of the door 11 and through the opening 16. A latch-operating stem 24 is supported for rotation in the depressed central surface 22 and includes an outer enlarged end portion 25 positioned within the pan-shaped housing. The latch-operating stem 24 is provided with an inner end portion 26 supported for rotation in a horizontal leg 30 of a support bracket 31. The inner end of the support bracket 31 is fixed on the inner surface of the depressed central surface 22, as by spot welding. A lock ring 32 is mounted in a groove on the inner end portion 36 of the latch-operating stem 24 to prevent axial movement of the latch-operating stem 24.

A T-shaped operating handle 35 is supported at one end on a pivot pin 36 which is fixed in the enlarged outer end portion 25 of the stem 24 and a spring-pressed disk 37 surrounds the enlarged outer end 25. The T-shaped handle 35 is resiliently maintained in the "flush" position shown in FIGS. 2–5 by the spring-pressed disk 37 and may be moved outwardly and into alignment with the stem 24 in order to manually rotate the latch-operating stem, for purposes to be presently described.

Figure 4:
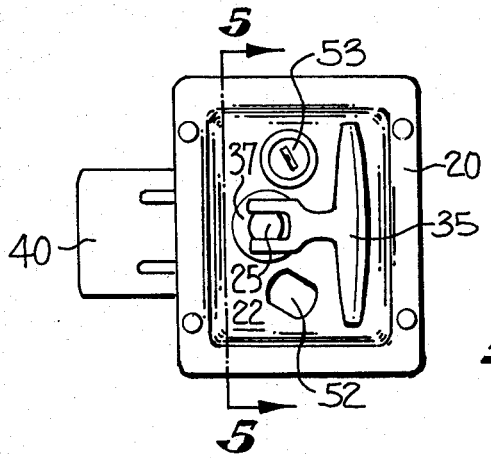
FIG. 4 is a view similar to FIG. 2 but illustrating a key-operated locking cylinder mounted in the upper knockout to convert the latch assembly to a latch-lock assembly.

The inner end portion of a latching pawl 40 (FIGS. 3 and 5) is fixed on a medial portion of the stem 24 and may be axially adjusted thereon by locking nuts 42. The latching pawl 40 is movable with rotation of the stem 24 between a latched horizontal position with the free outer end thereof in engagement with the latching rim 14 of the mating frame, and an unlatched vertical position with the free outer end out of engagement with the mating frame, as illustrated in dotted lines in FIG. 2. As illustrated in FIGS. 3 and 4, opposite sides of the stem 24 are flattened and the opening in the latching pawl 40 is flattened on opposite sides to mate with the flattened sides of the stem 24.

Figure 6:
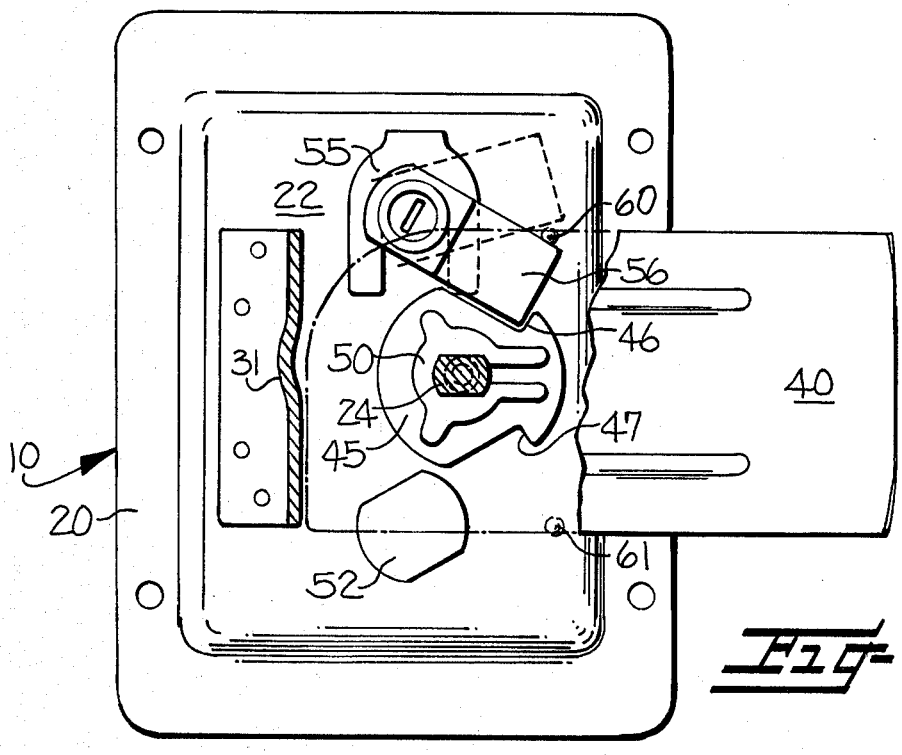
FIG. 6 is a vertical sectional view taken substantially along the line 6—6 in FIG. 5, with part of the latch panel broken away for purposes of clarity.

A locking collar 45 (FIG. 6) is fixed on the stem 24 and adjacent the inside of the depressed central surface 22. Locking notches 46, 47 are provided on each side of the locking collar 45 and positioned on opposite sides of the stem 24. A lock key 50 is positioned in a groove in the stem 24 and maintains the locking collar 45 in axial position on the stem 24. Knockouts 51, 52 (FIG. 2) are formed in the depressed central surface 22 and positioned on opposite sides of the stem 24. The knockouts are formed in the usual manner by depressing the metal so that they may be easily removed. Each knockout 51, 52 is provided with circular ends and flat sides to selectively receive a key-operated locking cylinder, to be presently described.

Figure 2:
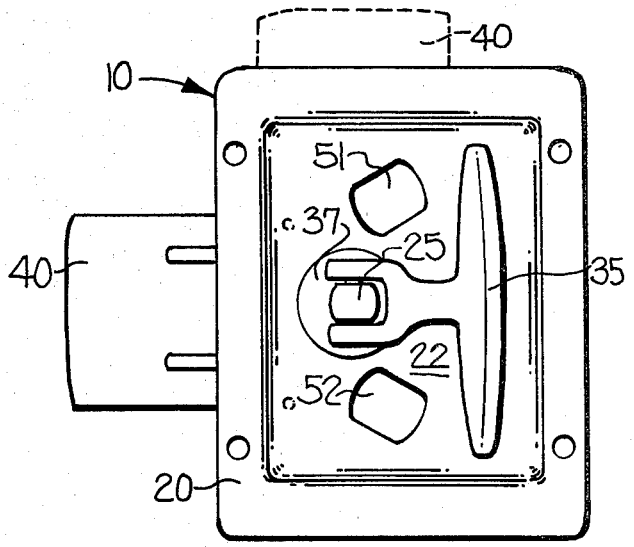
FIG. 2 is a front elevational view of the latch assembly, removed from the door.

The latch assembly of the present invention is manufactured as illustrated in FIGS. 1–3 and may be used for either right-hand or left-hand installations. The latch assembly is provided with the locking collar 45 and the knockouts 51, 52 so that it can be easily and quickly converted to a latch-lock assembly.

Figure 5:
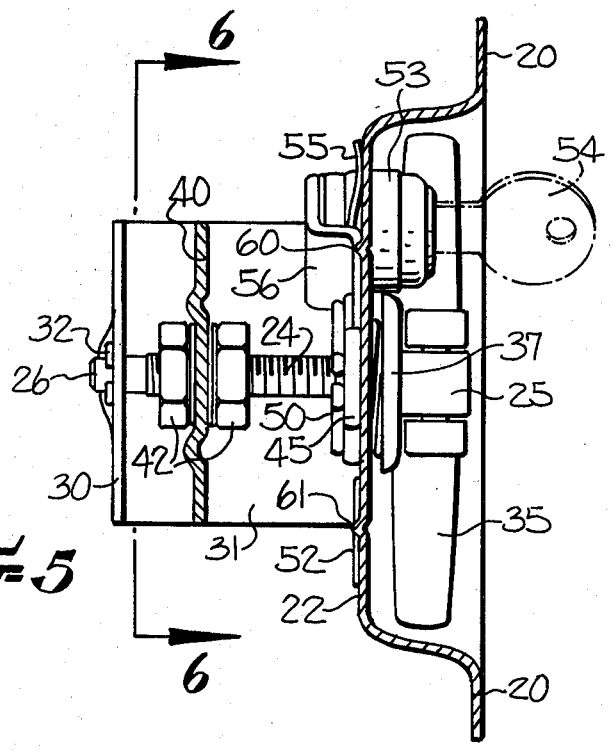
FIG. 5 is an enlarged vertical sectional view taken substantially along the line 5—5 in FIG. 4.

The latch assembly can be easily and quickly converted to a key-locking latch assembly, either before or after the latch assembly has been installed in a cabinet or the like, by simply removing the proper knockout 51 or 52 and installing a key-operated locking cylinder, indicated at 53 in FIGS. 4 and 5. The locking cylinder 53 is operated in the usual manner by a key 54, shown in dash-dot lines in FIG. 5.

To install the key-locking cylinder 53 in the latch assembly of FIGS. 1 and 2, it is merely necessary to remove the upper knockout 51 and insert the locking cylinder 53 into the opening. The locking cylinder 53 is retained in position by a lock spring 55 which is bifurcated at one end and slips into a groove in the body of the locking cylinder 54. The inner end of the locking cylinder 53 has the inner end of a locking arm 56 fixed thereon and the locking arm 56 is rotated by the key 54 and is movable between the locked solid line position and the unlocked dotted line position shown in FIG. 6.

Detents 60, 61 are formed in the depressed central surface 22 and extend inwardly to provide some resistance to rotation of the locking arm 56. When the locking arm 56 is moved to the locking position shown in FIG. 6, its outer free end is positioned in engagement with the locking notch 46 in the locking collar 45 to prevent rotation of the stem 24 and the latching pawl 40 in a counterclockwise direction. Thus, the latching pawl 40 cannot be moved from the locked position until key 54 is rotated to rotate the locking arm 56 to the dotted line position shown in FIG. 6. Then, the stem 24 and the latching pawl 40 may be rotated from the horizontal locked position to the vertical unlocked position. If the latch assembly 10 is installed in a cabinet in which the door 11 is hinged on the opposite side from that shown in FIG. 1, and it is then desired to convert the latch assembly to a latch-lock assembly, the key-operated locking cylinder 53 is then installed in the knockout 52 and the locking arm 56 will then be positioned to move into and out of locking engagement with the locking notch 47 of the locking collar 45.

In accordance with the present invention, it is only necessary to manufacture one type of latch assembly. This latch assembly can be easily converted to a latch-lock assembly, either before or after installation of the latch assembly in a right-hand or left-hand swinging panel or door. The present latch assembly thus eliminates the need for manufacturing and maintaining in inventory several different types of latch assemblies and permits the easy conversion from a latch assembly to a latch-lock assembly, either before or after installation of the latch assembly.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A latch assembly adaptable for use with a panel mounted for either right-hand or left-hand swinging movement in a mating frame and between open and closed positions, said latch assembly being easily convertible to a latch-lock assembly and comprising a. a pan-shaped housing including a peripheral rim mounted on and surrounding an opening in said panel, and a depressed central surface positioned in the opening in said panel, b. a latch-operating stem supported for rotation in said depressed central surface of said pan-shaped housing and including an outer end portion extending through said depressed central surface of said housing, and an inner end portion extending inwardly from said depressed central surface, c. an operating handle secured to said outer end portion of said latch-operating stem, said handle being manually operable to rotate said latch-operating stem, d. a latching pawl including an inner end fixed on a medial portion of said latch-operating stem and a free outer end extending outwardly therefrom, said latching pawl being movable with rotation of said latch-operating stem between a latched position with said free outer end in engagement with said mating frame and an unlatched position with said free outer end out of engagement with said mating frame, e. a locking collar fixed on said latch-operating stem and adjacent the inside of said depressed central surface, and f. a knockout formed in said depressed central surface of said pan-shaped housing and positioned on each side of said latch-operating stem, said knockouts being shaped to selectively receive a key-operated locking cylinder which is engageable with said locking collar to convert the latch assembly to a latch-lock assembly.

2. A latch assembly according to claim 1 wherein one of said knockouts is removed and a key-operated locking cylinder is positioned therein, wherein said locking collar includes locking notches positioned on each side of said latch-operating stem, and wherein said key-operated locking cylinder includes a locking arm movable between a locking position in engagement with one of said locking notches and an unlocked position out of engagement with said one of said locking notches.

3. A latch assembly according to claim 1 wherein said operating handle is T-shaped, and wherein said inner end portion of said latch-operating stem includes an enlarged head, and including a pivot pin fixed in said enlarged head and pivotally supporting said T-shaped handle thereon so that said T-shaped handle can be moved between a position at a right angle relative to said latch-operating stem and a position in alignment with said latch-operating stem.

4. A latch assembly according to claim 3 including a spring pressed disk surrounding said enlarged head of said latch-operating stem and bearing against the pivotal connection of said T-shaped handle, said spring pressed disk being operable to resiliently maintain said T-shaped handle in both of said right angle and said aligned positions relative to said latch-operating stem.

5. A latch-lock assembly adaptable for use with a panel mounted for either right-hand or left-hand swinging movement in a mating frame and between open and closed positions and comprising a. a pan-shaped housing including a peripheral rim mounted on and surrounding an opening in said panel, and a depressed central surface positioned in the opening in said panel, b. a latch-operating stem supported for rotation in said depressed central surface of said pan-shaped housing and including an outer end portion extending through said depressed central surface of said housing, and an inner end portion extending inwardly from said depressed central surface, c. an operating handle secured to said outer end portion of said latch-operating stem, said handle being manually operable to rotate said latch-operating stem, d. a latching pawl including an inner end fixed on a medial portion of said latch-operating stem and a free outer end extending outwardly therefrom, said latching pawl being movable with rotation of said latch-operating stem between a latched position with said free outer end in engagement with said mating frame and an unlatched position with said free outer end out of engagement with said mating frame, e. a locking collar fixed on said latch-operating stem and adjacent the inside of said depressed central surface, f. a knockout formed in said depressed central surface of said pan-shaped housing and positioned on each side of said latch-operating stem, said knockouts being shaped to selectively receive a key-operated locking cylinder, one of said knockouts being removed, and g. a key-operated locking cylinder positioned in said one knockout opening, said key-operated locking cylinder being movable into and out of engagement with said locking collar for locking and unlocking said latch-lock assembly.

* * * * *